United States Patent [19]

Höpf

[11] 4,335,641

[45] Jun. 22, 1982

[54] STRING INSTRUMENT

[76] Inventor: Dieter Höpf, Platter Strasse 67, 6204 Taunusstein 4, Fed. Rep. of Germany

[21] Appl. No.: 204,691

[22] Filed: Nov. 6, 1980

[30] Foreign Application Priority Data

Jun. 6, 1980 [DE] Fed. Rep. of Germany ... 8015071[U]

[51] Int. Cl.[3] ..... G10D 3/04; G10D 3/12

[52] U.S. Cl. ..... 84/297 R; 84/291; 84/298; 84/307

[58] Field of Search ..... 84/267, 291, 294, 297 R, 84/298, 299, 307, 313

[56] References Cited

U.S. PATENT DOCUMENTS 411,554 9/1889 Marsters ..... 84/298 X
496,706 5/1893 Stratton ..... 84/299
2,031,706 2/1936 Hambrecht et al. ..... 84/294
2,190,475 2/1940 Gretsch ..... 84/298
2,813,448 11/1957 Robinson ..... 84/299 X

*Primary Examiner*—Lawrence R. Franklin
*Attorney, Agent, or Firm*—Max Fogiel

[57] ABSTRACT

A string instrument, such as a guitar, has a resonance body and a bridge provided with a string-contacting surface. A string-supporting element is provided on the body and a string-securing device is also provided on the body but is separate from and spaced from the bridge and has a second string-contacting surface. One or more sound openings are provided in the resonance body and surround a center region of the bridge. A string-deflecting element is also provided on the center region of the bridge spaced from and opposite the first string-contacting surface.

23 Claims, 4 Drawing Figures

STRING INSTRUMENT

BACKGROUND OF THE INVENTION

The present invention relates to a string instrument, and more particularly to a guitar.

String instruments available on the market, and this includes in particular guitars, have a bridge which is located midway between the sound opening formed in the resonance body of the instrument and the lower edge of the body. This arrangement of the bridge and the opening in these instruments has been found to offer substantial disadvantages in terms of the sound string.

A proposal has been made in German Gebrauchsmuster No. 7,918,617.7 for substantially increasing the sound strength of a string instrument. According to this proposal the sound opening is completely surrounded by the bridge, in such a manner that the bridge and the mounting device for the strings are separated from one another by the sound opening. Because of the high tensile forces exerted by the tension strings and the lever action effective between the string contacting surface on the one hand and the string mounting device on the other hand, the cover board of the resonance body must be provided with reinforcing ribs on its underside (i.e. within the interior of the resonance body). Due to the presence of these reinforcing ribs a maximum sound strength cannot be achieved, because the vibrations of the resonance body are dampened by the presence of the reinforcing ribs. In addition, the reinforcing ribs have the disadvantage that they change the sound spectrum of the instrument.

SUMMARY OF THE INVENTION

It is, accordingly, an object of the present invention to overcome the disadvantages of the prior art.

A more particular object of the invention is to provide an improved string instrument which is not subject to the aforementioned disadvantages.

Still another object of the invention is to provide an improved string instrument wherein the cover sheet or board of the resonance body reacts more sensitively to the vibrations of the strings than what is known from the prior art, so that the sound strength is further increased without, however, resulting in disadvantages in terms of the sound spectrum.

Pursuant to the above objects, and to still others which will become apparent hereafter, one aspect of the invention resides in a string instrument which, briefly stated, may comprise a resonance body, a string ridge on the body having a first string-contacting surface, and a string-supporting element on the body. A string-securing device is also provided on the body but separate and spaced from the bridge and has a second string-contacting surface. At least one sound opening is formed in the body and surrounds a center region of the bridge. A string-deflecting element is provided on the center region of the bridge spaced from and opposite to the first string-contacting surface.

With this arrangement, and in particular with the location of the string-securing device away and remote from the bridge, it is possible to make the cover sheet or board of the resonance body substantially thinner than was heretofor conceivable, because the tensile forces of the tightened strings act not upon the cover sheet of the resonance body but upon the edge region of the resonance body where the string-securing device is mounted. As a result of this, the vibrations of the strings can be transmitted to a high degree and without damping to the cover sheet of the resonance body, thereby improving the sound resonance of the instrument.

It is particularly advantageous if the second string-contacting surface, i.e. the one of the string-securing device, is configurated as a crest or bead and rounded, the height of which is essentially accommodated to the level or height of the vibrating parts of the strings. According to another advantageous embodiment a string securing strip may be formed from a mounting part of the string-securing device and may be located within the confines of the mounting part or else in form of a projecting abutment extending outwardly from the mounting part.

The invention also contemplates for the string mounting strip to be a separate element in another embodiment, in which case the strip is connected with the mounting part with the aid of known connecting elements, e.g. pins, screws or the like. In a particularly advantageous embodiment the string-securing device may be of synthetic plastic material. It is also possible, however, for the string-securing device to be made of a hardwood, preferably palisander wood. If a wood is used, then it is advantageous if its grain or fibers extends transversely to the grain or fibers of the resonance body. Metal strips may be mounted on or in the second surface of the strip-securing device for contact with the strings so as to avoid wearing of the wood.

The wall thickness of the center region of the bridge is advantageously stronger than that of the region which surrounds the sound opening. In accordance with a particularly advantageous embodiment two sound holes may be arranged at opposite sides of the center region of the bridge, adjacent the ends of the second string-contacting surface or the bridge may be surrounded by a number of sound openings.

In accordance with another advantageous embodiment an additional sound opening or a number of such sound openings may be provided along the second string-contacting surface. A particularly helpful embodiment is obtained if the center region of the bridge is without interruptions in its cross section, but the center region may also be provided with one or more cutouts (i.e. interruptions of its cross section) which then act as additional sound openings.

The center region of the bridge may be completely surrounded by sound openings. The cutout or cutouts in the portion of the bridge surrounding the sound opening, if a single sound opening is provided, may be accommodated to the shape of the sound opening or, may be accommodated to the shape of multiple sound openings if such are provided. The sound openings may have any desired shape, from quadratic to rectangular (i.e. generally parallelepipedal) or rosette shaped, circular, or slot shaped.

It has been found to be advantageous if the string-deflecting element is provided with bores through which the strings can be passed and which are located at a level which is accommodated to the level of the vibrating parts of the strings, in accordance with the type of use intended for the string instrument. It is particularly advantageous if the bridge is of a hardwood, preferably palisander wood, and if again the grain or fibers thereof extend transversely to the grain or fibers of the resonance body.

The invention will hereafter be described with reference to exemplary embodiments as illustrated in the drawing. However, it will be understood that this is for purposes of explanation only and that the invention is definitively defined only in the appended claims.

DESCRIPTION OF PREFERRED EMBODIMENTS

Figure 1:
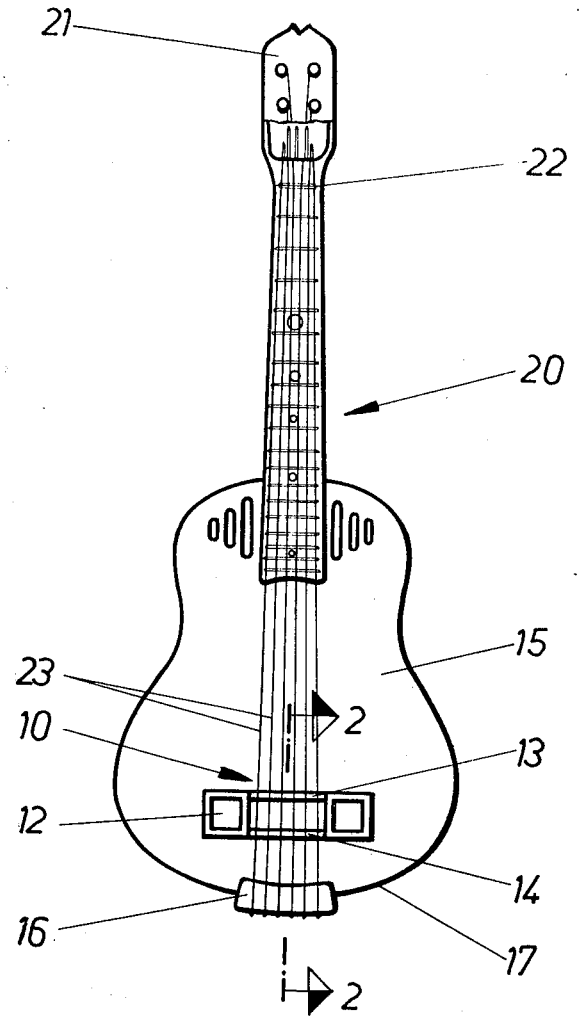
FIG. 1 is a plan view of a string instrument, for example of a guitar.
Figure 2:
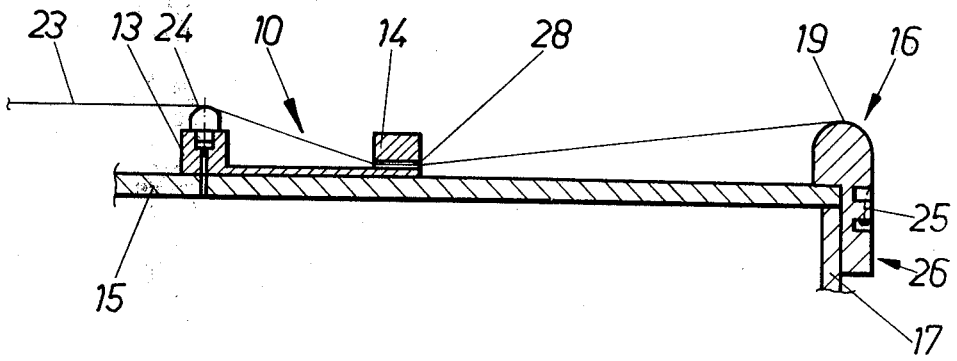
FIG. 2 is a section taken on line 2—2 of FIG. 1.

The string instrument illustrated in FIG. 1 is here shown as a guitar 20, the neck 21 of which is provided with a saddle 22; in connection with the string contacting and supporting surface 13 the saddle 22 defines the scale length of the guitar 20. As usual, a number of strings 23 is provided; these are connected to the string-securing device 16 which according to the invention is mounted on the edge 17 of the resonance body of the guitar. As shown in FIG. 2, the securing of the strings 23 is via a string mounting strip 25 which is formed within the confines of the mounting part 26.

The string-securing device 16 may be secured to the edge 17 of the resonance body in any desired and suitable manner, for example by means of an adhesive known per se in the art. The device 16 has a curved bead 19 which serves as the second string-contacting surface and extends upwardly beyond the upper cover board 15 of the resonance body, to such an extent that it is located at a level which corresponds essentially with the level of the vibrating strings 23, i.e. with the height of the string carriers 24 which are provided on the first string-supporting and contacting surface 13.

A string-deflecting element 14 is provided in which bores 28 are formed. The strings 23 coming from the string carriers 24 are passed through the bores 28 and from there deflected in accordance with the height of the bead 19, whereupon they are connected to the string mounting strip 25 under appropriate tension. As a result of the mounting of the string-deflecting element 14 intermediate the surface 13 and the device 16 lever conditions are obtained—which can be varied in accordance and in dependence with the type of use of the instrument 20—which serve to amplify the vibrations of the bridge caused by the string vibrations. As a result, an upwardly directed force acts upon the upper cover sheet 15 of the resonance body in the region of the string-deflecting element 14 in combination with a downwardly directed force acting upon the upper cover sheet 15 in the region of the string carrier or saddle 24. Therefore, when the strings 23 are plucked, the appropriate reverse vibrations are amplified in accordance with the lever conditions which are obtained, as may be seen particularly from FIG. 2.

Figure 3:
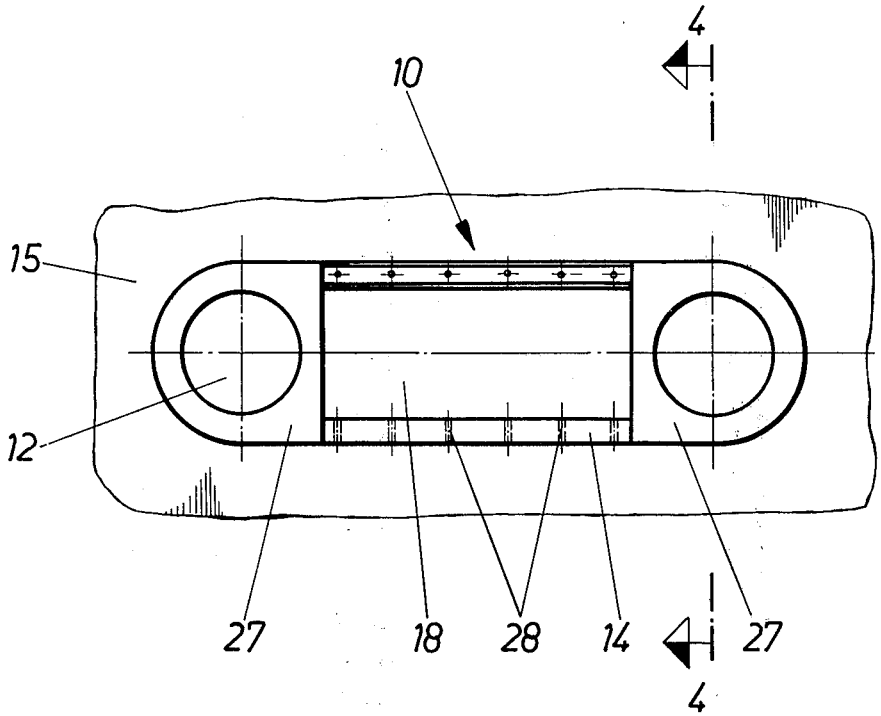
FIG. 3 is a plan view of the bridge and a sound opening of the embodiment in FIGS. 1 and 2.
Figure 4:
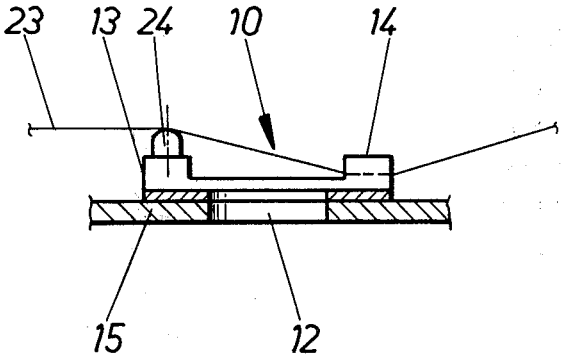
FIG. 4 is a section taken on line 4—4 of FIG. 3.

A top-plan view of the bridge 10 is shown in FIG. 3. It will be seen that the bridge 10 has a center region 18 which in this embodiment is formed without cross section or interruptions, i.e. without cutouts or the like. However, according to a not illustrated embodiment the region 18 may be provided with one or more cutouts which then serve as additional sound openings. As also shown in FIGS. 3 and 4, regions 27 are formed at opposite sides of the center region 18 which surround the sound opening 12. These regions 27 have a wall thickness which is substantially thinner than that of the center region 18 and they are provided with cutouts which correspond to the contour of the sound opening 12. In addition to the illustrated sound opening arrangement as shown in FIG. 3, it should be understood that sound openings 12 may also be arranged in any desired manner so as to surround the bridge 10.

It is to be noted that the arrangement of the sound openings and the configuration thereof will have a noticeable influence upon the vibration behavior of the resonance body of the instrument and thus upon the acoustical characteristics thereof. With the construction of the bridge in accordance with the invention the desired acoustical characteristics of the instruments can readily be obtained and selected by appropriate arrangement of the sound openings and shaping of the sound openings, for example in a quadratic, rectangular, rosette shaped, or circular or slot-shaped configuration.

The drawing illustrates an exemplary embodiment of the invention to facilitate a better understanding thereof. However, it is to be understood that this is not to be considered limiting and that the scope of protection which is desired for the invention is definitively defined only in the appended claims.

What is claimed is:

1. A string instrument, comprising: a resonance body; a neck mounted to said resonance body and havng a first string-contacting saddle arranged in a first level above the upper surface of said resonance body; a string-securing device mounted to said resonance body opposite to said neck and containing a second string-contacting saddle arranged in a second level above the upper surface of the said resonance body; a string bridge on said resonance body between said neck and said string-securing device, said string bridge having a third string-contacting saddle arranged in a third level above the upper surface of said resonance body and a string-deflecting element provided on the center region of the said string bridge opposite said third string-contacting saddle and being arranged in a fourth level above the upper surface of said resonance body; said fourth level being arranged nearer to said upper surface of the said resonance body than said second and third levels so that the strings extending from said neck to said strings-securing device over the first and second and third saddles and through said string-deflecting element are V-shape formed between said second and third saddles.

2. String instrument as defined in claim 1, wherein said second string-contacting saddle has the shape of a raised bead, the height of said bead being substantially in the same level as the level of the vibratory portions of the strings extending between said first and third saddles.

3. String instrument as defined in claim 1, said string-securing device including a mounting part and a string-securing strip.

4. String instrument as defined in claim 3, said strip being located below said mounting part.

5. A string instrument as defined in claim 1, wherein said V-shape forces tightened strings at said second saddle to press against a cover board of said resonance body while pulling on said cover board at said string-deflecting element to produce a force couple for predetermined deformation of the bridge, said V-shape converting longitudinal vibrations between said second and third saddles into substantially wide rocking oscillations of said bridge, said longitudinal vibrations and said rocking oscillations cooperating to reinforce string harmonics.

6. String instrument as defined in claim 3, said strip and said mounting part being connected.

7. String instrument as defined in claim 1, said string-securing device being of synthetic plastic material.

8. String instrument as defined in claim 1, said string-securing device being of a hardwood having a grain which extends transverse to a grain of said body.

9. String instrument as defined in claim 8, said hardwood being palisander wood.

10. A string instrument as defined in claim 1, wherein said string-securing device includes a mounting part and a string-securing strip, said strip being located below said mounting part, said strip and said mounting part being connected, said second string-contacting saddle having the shape of a raised bead, the height of said bead being substantially in the same level as the level of the vibratory portions of the strings extending between said first and third saddles, at least one portion of the string bridge being shaped as a frame secured on the upper surface of said resonance body, at least one sound opening being provided in the upper wall of said resonance body and being arranged within said frame-like portion of said string bridge, said string bridge including a center region and two frame-like portions surrounding two sound openings located at opposite sides of said center region adjacent the respective ends of said bridge.

11. String instrument as defined in claim 1, wherein in at least one portion of the string bridge is shaped as a frame secured on the upper surface of said resonance body, at least one sound opening being provided in the upper wall of said resonance body and being arranged within said frame-like portion of said string bridge.

12. String instrument as defined in claim 11, said string bridge including a center region and two frame-like portions surrounding two sound openings located at opposite sides of said center region adjacent the respective ends of said bridge.

13. String instrument as defined in claim 11, said bridge having a central region provided with a wall thickness greater than that of a portion of the bridge which surrounds a hole in said body.

14. String instrument as defined in claim 11, said bridge including a central region, a plurality of sound openings said sound openings surrounding said central region.

15. String instrument as defined in claim 14, said central region being continuous and free of interruptions of its cross section.

16. String instrument as defined in claim 14, said central region having at least one interruption of its cross section of a contour in conformance with the shape of the sound openings.

17. String instrument as defined in claim 11, said bridge having a portion surrounding said sound opening and provided with a cutout corresponding to the contour thereof.

18. String instrument as defined in clalm 11, said sound opening having a parallelepiped outline.

19. String instrument as defined in claim 11, said sound opening having a rosette-shaped outline.

20. String instrument as defined in claim 11, said sound opening having a circular outline.

21. String instrument as defined in claim 11, said sound opening having an elongated generally slot-shaped outline.

22. String instrument as defined in claim 1, said bridge being of a hardwood having a grain which is inclined to the grain of said body.

23. String instrument as defined in claim 22, said hardwood being palisander wood.

* * * * *

UNITED STATES PATENT AND TRADEMARK OFFICE

CERTIFICATE OF CORRECTION

PATENT NO. : 4,335,641

DATED : June 22, 1982

INVENTOR(S) : Dieter Hopf

It is certified that error appears in the above-identified patent and that said Letters Patent are hereby corrected as shown below:

The name of the inventor appearing on the front page, in the left column next to [76] and above [54] should read --Dieter Hopf--

Signed and Sealed this

Sixteenth Day of November 1982

[SEAL]

*Attest:*

GERALD J. MOSSINGHOFF

*Attesting Officer*

*Commissioner of Patents and Trademarks*